US005251353A

United States Patent [19]

Lin

[11] Patent Number: 5,251,353

[45] Date of Patent: Oct. 12, 1993

[54] MULTIPURPOSE PLIER

[76] Inventor: Ming-Shi Lin, No. 59-50, Tung-Shan Rd., Ching-Shui Chen, Taichung Hsien, Taiwan

[21] Appl. No.: 41,704

[22] Filed: Apr. 1, 1993

[51] Int. Cl.[5] ..... B25F 1/04

[52] U.S. Cl. ..... 7/128; 7/107; 7/137; 7/129; 7/138

[58] Field of Search ..... 7/125, 127, 128, 129, 7/130, 131, 137, 107, 165, 138, 143, 144

[56] References Cited

U.S. PATENT DOCUMENTS 5,033,140 7/1991 Chen et al. ..... 7/127
5,142,721 9/1992 Sessions et al. ..... 7/128

FOREIGN PATENT DOCUMENTS 0422079 6/1947 Italy ..... 7/128
0078928 9/1918 Switzerland ..... 7/128
0140193 8/1930 Switzerland ..... 7/128

*Primary Examiner*—Roscoe V. Parker
*Attorney, Agent, or Firm*—Willian Brinks Olds Hofer Gilson & Lione

[57] ABSTRACT

A plier has first and second handle portions. The first handle portion has a tool receiving channel which extends from a rear end thereof to receive a tool bit therein. The second handle portion has an elongated groove to receive a blade carrier. The blade carrier has a plurality of cutting devices mounted thereon and engaging pieces to retain the blade carrier in the elongated groove when the blade carrier is press-fitted in the elongated groove.

2 Claims, 7 Drawing Sheets

MULTIPURPOSE PLIER

BACKGROUND OF THE INVENTION

1. Field of the Invention

The invention relates to a plier, more particularly to a multipurpose plier which has handle portions that can receive additional tools therein.

2. Description of the Related Art

FIG. 1 shows a conventional plier (1) which is used to effect clamping, pinching and cutting. To accomplish a given task, a workman needs different kinds of tools for different purposes. If the conventional plier can be modified so as to permit accomplishment of additional tasks, such as the turning of a bolt or screw or the stripping of a wire sheath, the tools that are to be taken along by the workman can be reduced.

SUMMARY OF THE INVENTION

Therefore, a main objective of the present invention is to provide a multipurpose plier which can be used to perform additional tasks, thereby reducing the number of tools to be brought by a workman.

According to the present invention, a tool bit receiving channel is to be provided in one of the handle portions, while a blade-carrier receiving groove is provided in the remaining handle portion of a conventional plier. The tool bit receiving channel is polygonal in cross section and has several sides to prevent rotation of a tool bit. The blade carrier has a plurality of cutting devices mounted pivotally thereon. Since only additional tool bits and the blade carrier are needed to be brought in order to perform the tasks of different conventional tools, the burden of carrying a lot of conventional tools is reduced when the workman is equipped with the multipurpose plier of the present invention.

In one preferred embodiment of the present invention, the internal surface of the second handle portion has a second elongated groove formed along the length of the same, a first wall adjacent to a pivot point of the handle portions of plier, a second wall opposite to the first wall and a pair of opposed parallel walls that interconnect the first and second walls so as to define the second elongated groove. The second wall has a blind bore which is aligned axially with the first elongated groove. A compression spring is attached to an innermost end of the blind bore. The compression spring has a support disc disposed adjacent to an outermost end of the blind bore. The second handle portion has a pair of ears formed between the first and second walls and located adjacent to the first wall. A generally L-shaped plate is pivoted to the pair of ears. The L-shaped plate has first and second sections which cooperate to define a concave face therebetween. The concave face faces the second elongated groove when the L-shaped plate is pivoted to a predetermined position. When the L-shaped plate is in the predetermined position, the first section of the L-shaped plate extends into the second elongated groove and abuts the first wall.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENT

Figure 1:
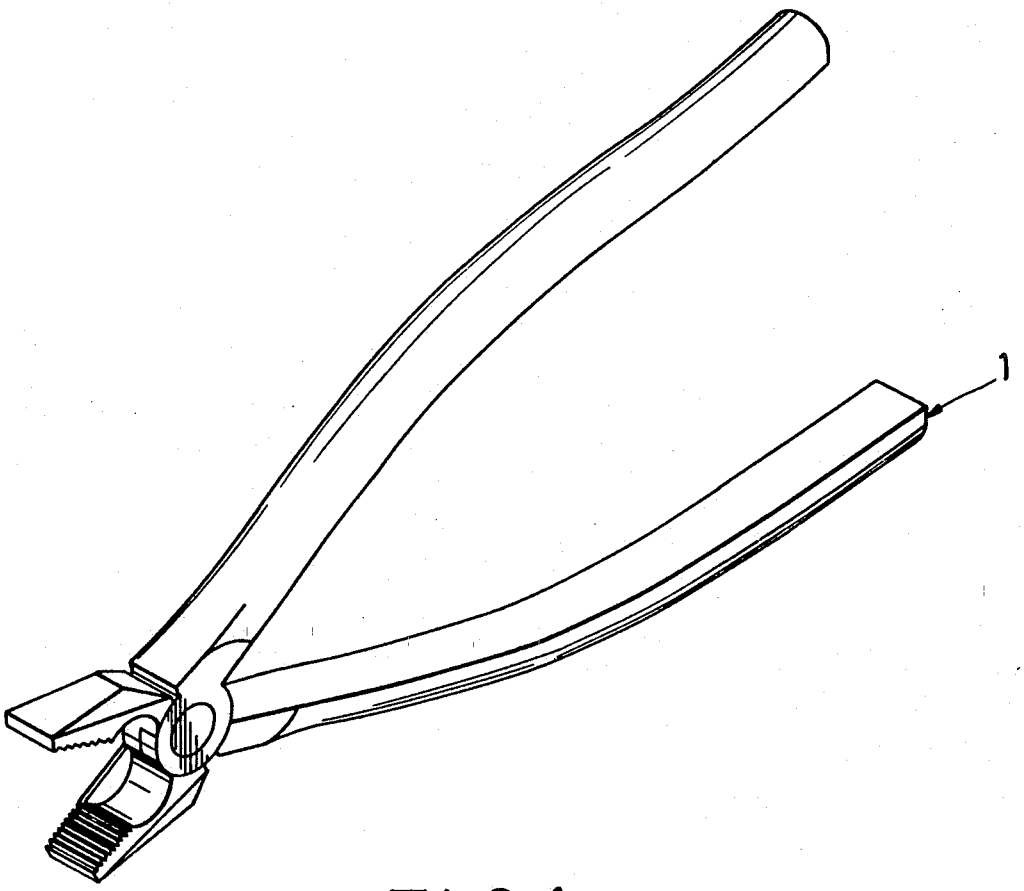
FIG. 1 PRIOR ART
FIG. 1 is a perspective view of a conventional plier.
Figure 2:
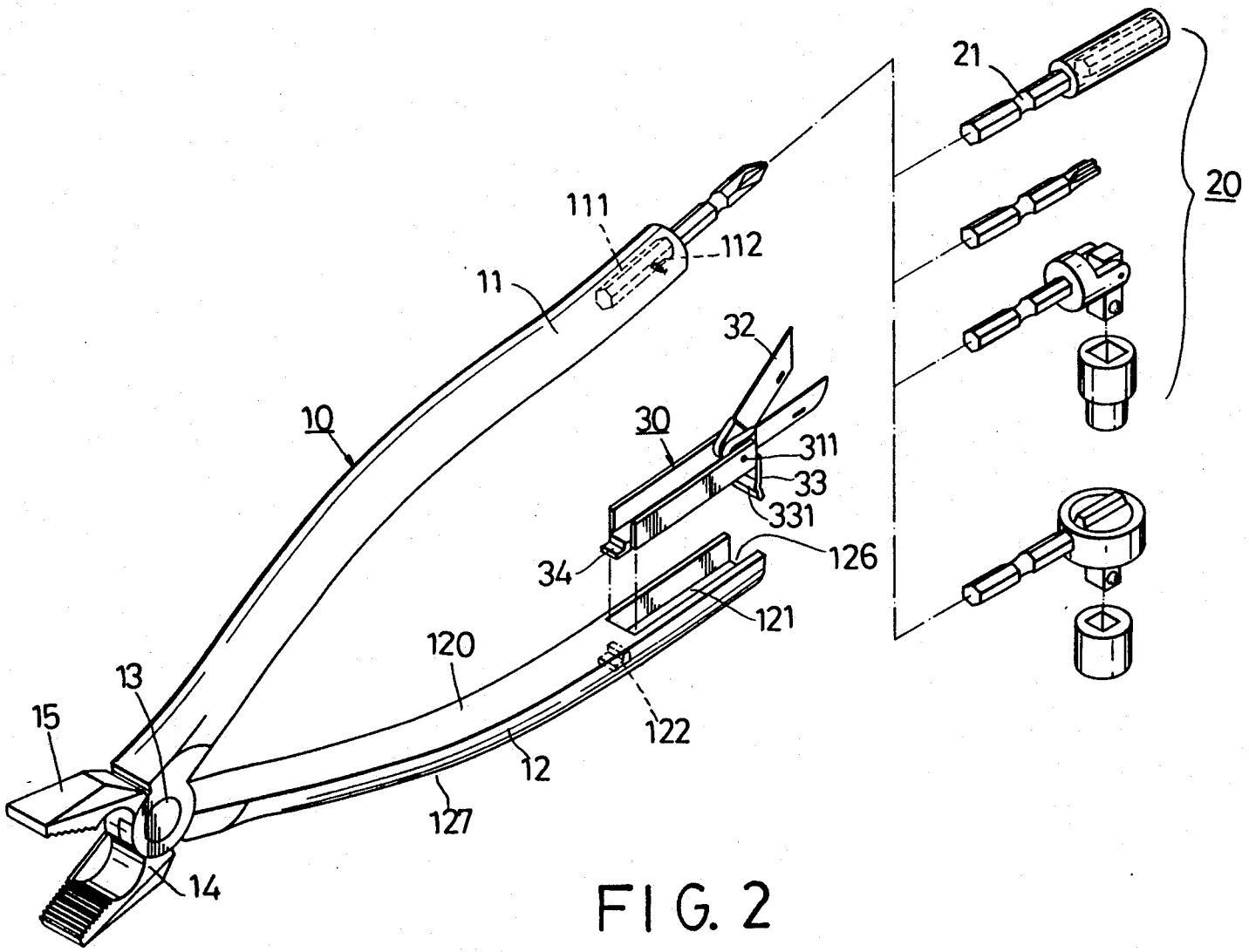
FIG. 2 is an exploded view of a multipurpose plier of the present invention.

Referring to FIG. 2, a multipurpose plier (10) according to the present invention includes first and second handle portions (11, 12) which are respectively provided with a jaw (14, 15) at a front end. The first and second handle portions (11, 12) are pivotally adjacent to the front ends thereof by means of a pintle (13). The first handle portion (11) is formed with a receiving channel (111) that extends interiorly from a rear end thereof. The second handle portion (12) has an internal surface (120) opposite the first handle portion (11), an external surface (127) opposite to the internal surface (120), and a first elongated groove (121) which is formed in the internal surface (120) and which extends from a predetermined position toward a rear end (126) thereof.

The receiving channel (111) is polygonal in cross section with a predetermined number of sides so as to prevent rotation of a tool bit (20) that is received therein. The receiving channel (111) is further provided with a resilient retaining projection (112) which extends into a retaining recess (21) formed in an external surface of the tool bit (20), thereby preventing untimely axial disengagement of the tool bit (20) from the receiving channel (111).

Figure 3:
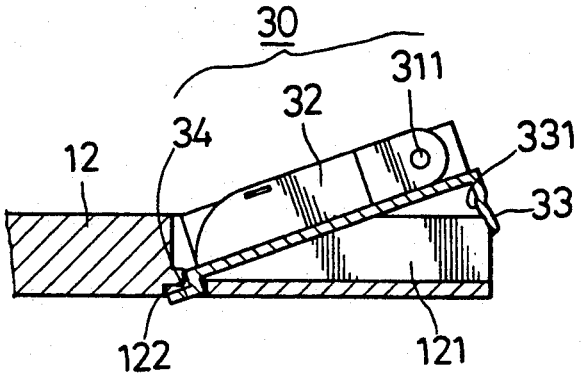
FIG. 3 illustrates how a blade carrier is mounted to the handle portion of the multipurpose plier shown in FIG. 2.
Figure 4:
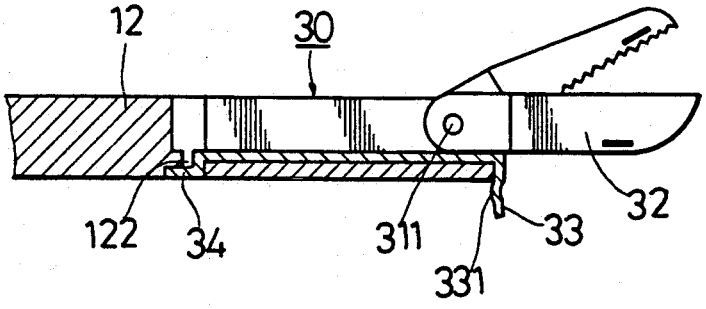
FIG. 4 shows a side view of the blade carrier of the multipurpose plier of the present invention when in use.
Figure 5:
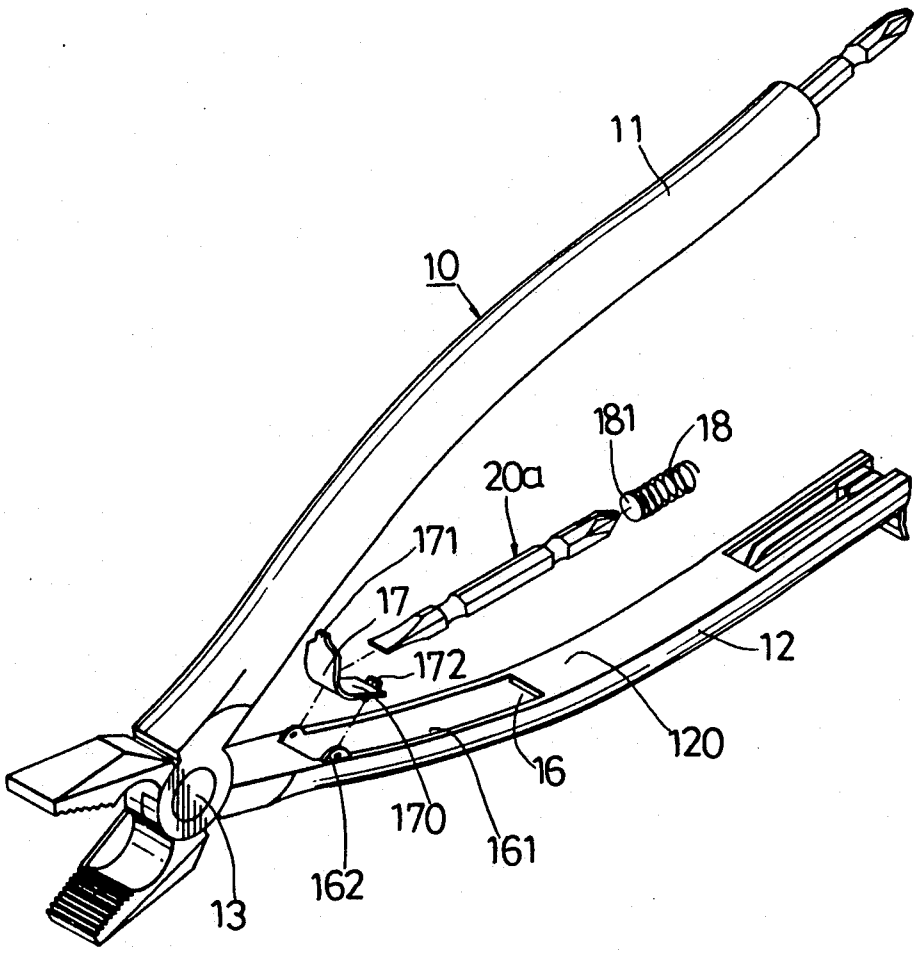
FIG. 5 shows an exploded view of a second preferred embodiment of a multipurpose plier of the present invention.
Figure 6:
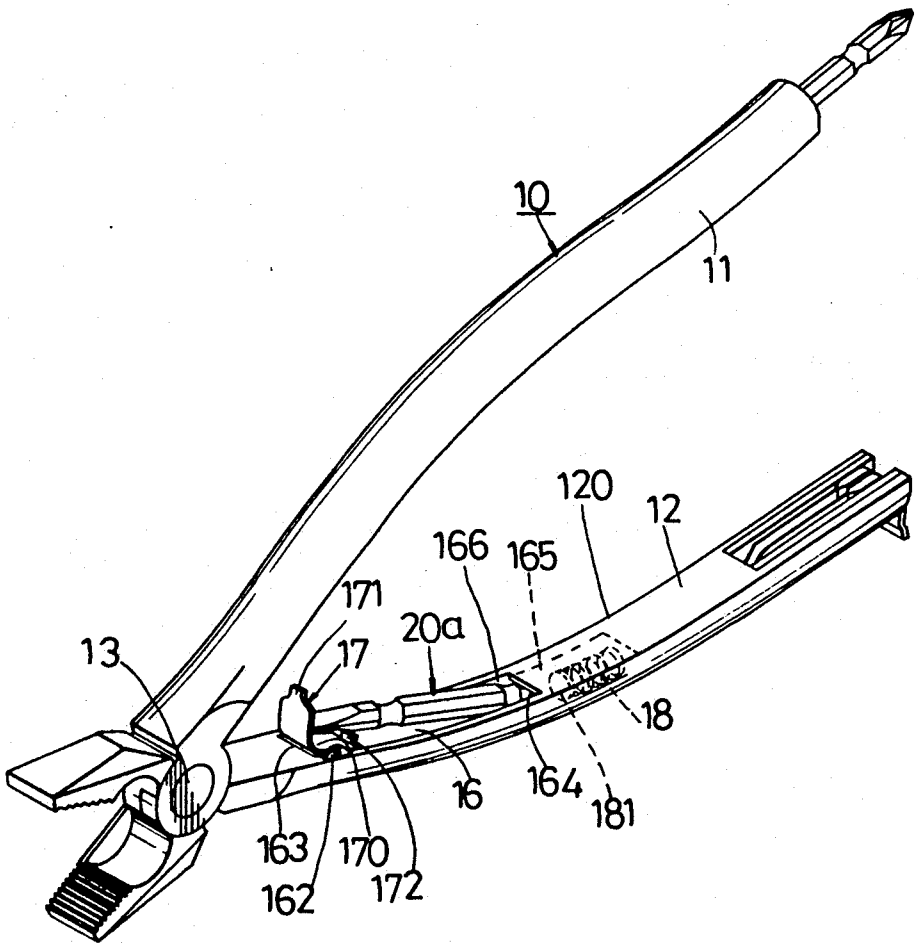
FIG. 6 is a perspective view of the second preferred embodiment shown in FIG. 5.

The second handle portion (12) further has an engaging hole (122) which is formed through the external surface (127) adjacent to the predetermined position and which communicates the first elongated groove (121) and the external surface (127). A blade carrier (30) has a shape that conforms to the first elongated groove (121) and further has a plurality of cutting devices (32) mounted pivotally about a pintle (311), a first engaging piece (34) which is received in the engaging hole (122), and a second engaging piece (33) which has a protrusion (331) that engages releasably the rear end (126) when the blade carrier (30) is press-fitted in the first elongated groove (121) of the second handle portion (12), as shown in FIGS. 3 and 4.

A variety of tool bits (20) is available to permit the execution of different tasks, such as the turning of a screw, rotating a nut and the like. The cutting devices (32) of the blade carrier (30) can be used to perform different cutting operations, such as slicing an article or stripping a wire sheath. A workman who possesses the multipurpose plier of the present invention would only need to bring the additional tool bits (20) and the blade carrier (30) to perform the tasks of different conventional tools. Thus, the burden of carrying a lot of conventional tools is eliminated.

In one preferred embodiment of the present invention, the internal surface (120) of the second handle portion (12) has a second elongated groove (16) formed along the length of the same, a first wall (163) located adjacent to the pintle (13), a second wall (164) which is located opposite to the first wall (163), and a pair of opposed parallel walls (166) which interconnect the first and second walls (163, 164). The first and second walls (163, 164) and the opposed parallel walls (166) cooperate to define the second elongated groove (16). The second wall (164) has a blind bore (165) that is aligned axially with the first elongated groove (121). The internal surface (120) further has two opposed upwardly projecting ears (162) which are formed between the first and second walls (163, 164) and which is disposed adjacent to the first wall (163). A substantially L-shaped pivot plate (17) is pivoted to the pair of ears (162) and has a first and second sections (173, 174) which cooperates to define a concave face (170) at one side of the L-shaped plate (17). The first section (173) of the L-shaped plate (17) is further provided with a protrusion (172) that forms a predetermined angle relative to the first section (173) and that is located on the same side as that of the concave face (170). A compression spring (18) is attached securely to an innermost end of the blind bore (165). The compression spring (18) further has a support disc (181) which is attached to a free end thereof which is disposed adjacent to an outermost end of the blind bore (165).

Figure 7:
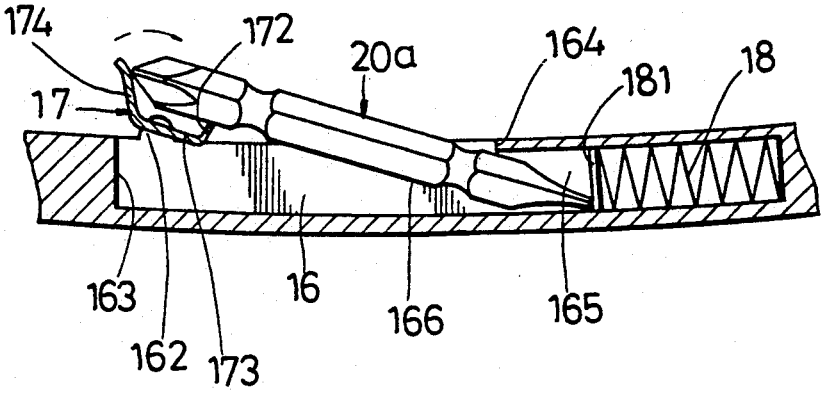
FIG. 7 is a fragmentary view of the multipurpose plier of the present invention to illustrate the insertion of a tool bit in a tool receiving groove formed in the handle portion.
Figure 8:
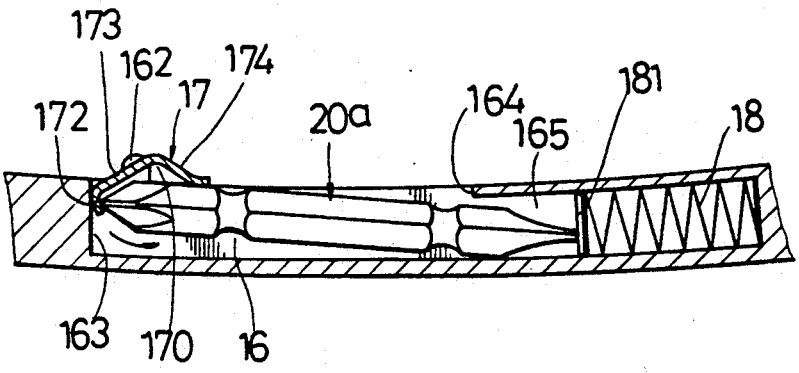
FIG. 8 is a fragmentary view of the multipurpose plier of the present invention to illustrate the tool bit when concealed in the tool receiving chamber of the second handle portion.

When concealing the tool bit (20*a*) in the second elongated groove (16) of the second handle portion (12), one end of the tool bit (20*a*) is inserted into the blind bore (165) against biasing action of the compression spring (18). The other end of the tool bit (20*a*) is pressed against the concave face (170) of the L-shaped pivot plate (17). The L-shaped plate (17) is pivoted in the direction of the arrow shown in FIG. 7, to place the L-shaped plate (17) at a predetermined position, as illustrated in FIG. 8. At this stage, the first section (173) of the L-shaped plate (17) extends into the second elongated groove (16), while the protrusion (172) of the same abuts the first wall (163). The concave face (170) of the L-shaped plate (17) is disposed correspondingly at a position facing the second elongated groove (16). This illustrates how the tool bit (20*a*) is concealed in the multipurpose plier of the present invention.

When it is desired to remove the tool bit (20*a*) from the second elongated groove (16), the L-shaped plate (17) is pivoted in a second direction opposite to the arrow. The protrusion (172) of the L-shaped plate (17) propels one end of the tool bit (20*a*) out of the second elongated groove (16) against biasing action of the compression spring (18).

Figure 9:
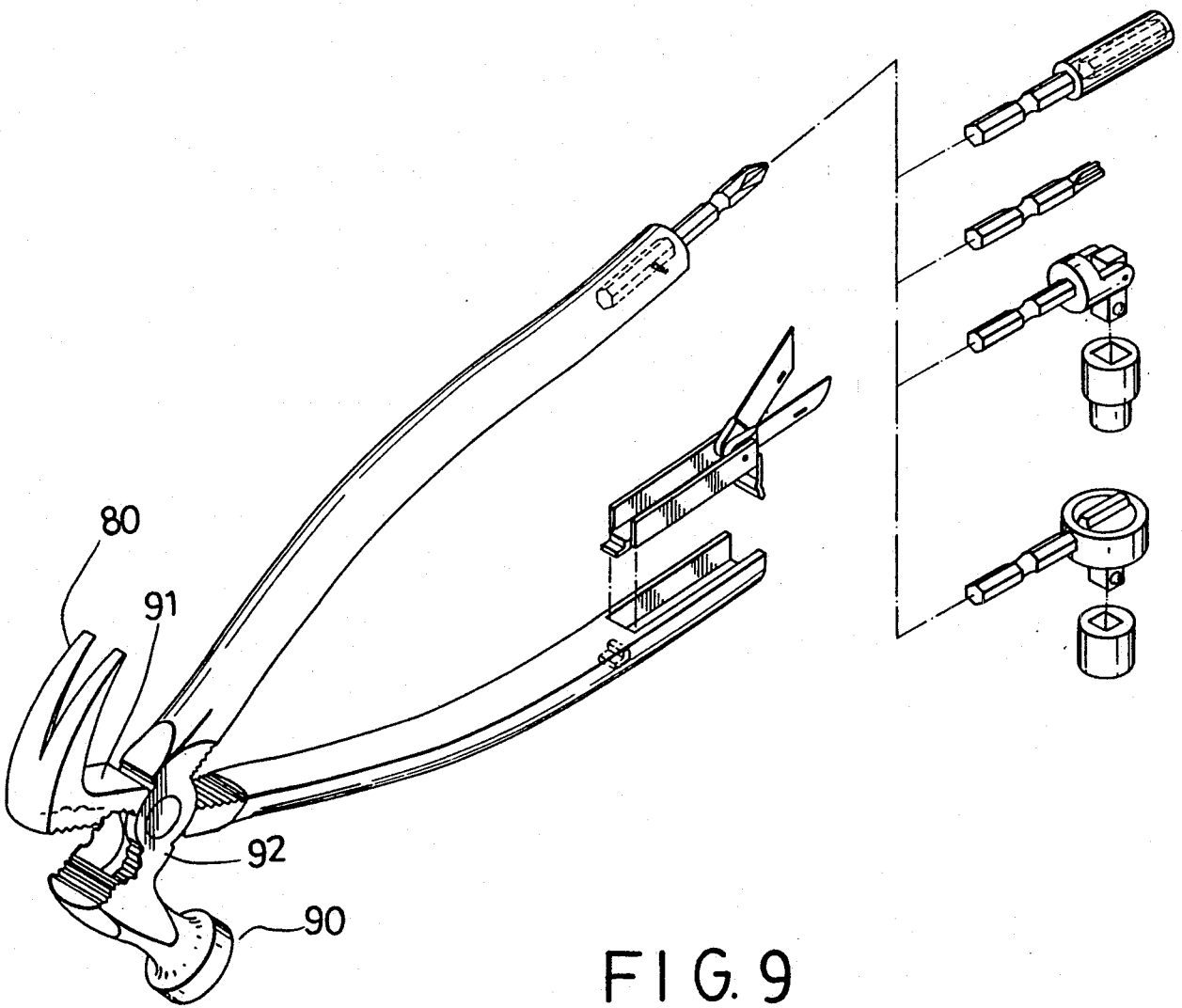
FIG. 9 shows a third preferred embodiment of a multipurpose plier of the present invention.

Referring to FIG. 9, another preferred embodiment of a multipurpose plier of the present invention is shown to comprise a nail pulling unit (80) which is provided on the jaw (91) of the first handle portion and a hammer unit (90) which is disposed on the jaw (92) of the second handle portion of the multipurpose plier of the present invention. The objects and features of this embodiment are the same as those of the previous embodiments.

While preferred embodiments have been described and illustrated, it will be apparent that many changes and modifications can be made in the general construction and arrangement of the present invention without departing from the scope and spirit thereof. Therefore, it is desired that the present invention be not limited to the exact disclosure but only to the extent of the appended claims.

I claim:

1. A multipurpose plier including first and second handle portions, each of which having a front end, a rear end and a jaw formed on said front end, said first and second handle portions being connected pivotally at a pivot point adjacent to said front end;

the improvements comprising: said first handle portion having a receiving channel which extends interiorly from said rear end thereof, said receiving channel being polygonal in cross section;

a tool bit inserted detachably in said receiving channel;

means for retaining said tool bit in said receiving channel;

said second handle portion having an internal surface, an external surface opposite to said internal surface, and a first elongated groove which extends from a predetermined position in said internal surface toward said rear end of said second handle portion, said second handle portion further having an engaging hole which is formed adjacent to said predetermined position and which communicates said first elongated groove and said external surface of said second handle portion; and a blade carrier having a shape that conforms to said first elongated groove of said second handle portion and having a plurality of cutting devices mounted pivotally thereon, a first engaging piece and a second engaging piece opposite to said first engaging piece, said first engaging piece being received in said engaging hole, said second engaging piece having a protruded portion which engages releasably said rear end of said second handle portion when said blade carrier is press-fitted in said first elongated groove.

2. A multipurpose plier as defined in claim 1, wherein said internal surface of said second handle portion has a second elongated groove which extends along a length of said second handle portion, a first wall adjacent to said pivot point, a second wall opposite to said first wall and two opposed parallel walls interconnecting said first and second walls, said first and second walls and said opposed parallel walls cooperatively defining said second elongated groove, said second wall having a blind bore which extends along the length of said second handle portion, said multipurpose plier further comprising a compression spring which has a first end that is attached securely to an innermost end of said blind bore and a second end that is connected to a support disc and that is disposed adjacent to an outermost end of said blind bore, said internal surface further having a pair of opposed ears formed between said first and second walls and being disposed adjacent to said first wall, a generally L-shaped plate being pivoted to said pair of opposed ears and having first second sections which cooperate to define a concave face at one side of said L-shaped plate, said first section of said L-shaped plate further having a protrusion which extends from a free end thereof and which forms a predetermined angle relative said first section, said protrusion being located on said one side of said L-shaped plate, said L-shaped plate being pivoted in a first direction so as to allow said first section of said L-shaped plate to extend into said second elongated groove and so as to permit said concave face of said L-shaped plate to face said second elongated groove, said protrusion preventing said L-shaped plate from rotating in said first direction when said protrusion abuts said first wall.

* * * * *

UNITED STATES PATENT AND TRADEMARK OFFICE

CERTIFICATE OF CORRECTION

PATENT NO. : 5,251,353
DATED : October 12, 1993
INVENTOR(S) : Ming-Shi Lin

It is certified that error appears in the above-indentified patent and that said Letters Patent is hereby corrected as shown below:

Column 4, line 55, claim 2, after "first" insert --and--.

Signed and Sealed this

Twenty-fifth Day of October, 1994

*Attest:*

*Attesting Officer*

Bruce Lehman

BRUCE LEHMAN

*Commissioner of Patents and Trademarks*